US007935656B2

(12) United States Patent
Elmasry et al.

(10) Patent No.: US 7,935,656 B2
(45) Date of Patent: May 3, 2011

(54) THERMOSENSITIVE RECORDING MEDIA AND METHODS OF MAKING AND USING THE SAME

(75) Inventors: Mohamed A. Elmasry, Merrimack, NH (US); William M. Sawyer, Nashua, NH (US)

(73) Assignee: Nashua Corporation, Nashua, NH (US)

( * ) Notice: Subject to any disclaimer, the term of this patent is extended or adjusted under 35 U.S.C. 154(b) by 963 days.

(21) Appl. No.: 11/827,559

(22) Filed: Jul. 12, 2007

(65) Prior Publication Data

US 2008/0015107 A1 Jan. 17, 2008

Related U.S. Application Data

(60) Provisional application No. 60/830,642, filed on Jul. 13, 2006.

(51) Int. Cl.
*B41M 5/30* (2006.01)

(52) U.S. Cl. ..... 503/201; 427/150; 503/207

(58) Field of Classification Search ..... None
See application file for complete search history.

(56) References Cited

U.S. PATENT DOCUMENTS 4,722,921 A * 2/1988 Kiritani et al. ..... 503/207
7,098,168 B2 * 8/2006 Iwasaki et al. ..... 503/209

FOREIGN PATENT DOCUMENTS

| | | | |
|---|---|---|---|
| EP | 0897809 | | 2/1999 |
| EP | 0958934 | | 11/1999 |
| EP | 0967089 | | 12/1999 |
| GB | 2320582 | | 6/1998 |
| JP | 1970-042772 | * | 5/1970 |

OTHER PUBLICATIONS

International Search Report for International Application No. PCT/US2007/016025, mailed from the International Searching Authority on Dec. 27, 2007.

Written Opinion of the International Searching Authority for International Application No. PCT/US2007/016025, mailed from the International Searching Authority on Dec. 27, 2007.

* cited by examiner

*Primary Examiner* — Bruce H Hess

(74) *Attorney, Agent, or Firm* — St. Onge Steward Johnston & Reens LLC

(57) ABSTRACT

The present teachings provide thermosensitive recording compositions which are useful for preparing thermosensitive recording media for displaying images. The thermosensitive recording media can include a substrate, a thermosensitive recording composition, and a topcoat. Methods of preparing and using the thermosensitive recording media also are disclosed.

18 Claims, 1 Drawing Sheet

THERMOSENSITIVE RECORDING MEDIA AND METHODS OF MAKING AND USING THE SAME

RELATED APPLICATIONS

This application claims priority to U.S. Provisional Patent Application 60/830,642 filed on Jul. 13, 2006, the disclosure of which is herein incorporated by reference in its entirety.

FIELD

The present teachings relate to thermal recording media and methods of making and using the same.

INTRODUCTION

Thermal or heat-sensitive recording materials are well known in the art. Generally, these materials include a support (e.g., paper or film) onto which a light or colorless color-developing layer is formed. The color-developing layer typically includes both a color-forming substance (e.g., a leuco dye) and a developer (e.g., an acidic substance). When the color-developing layer is selectively exposed to heat, for example, by using a thermal print head, the color-forming substance and the developer in the sufficiently exposed areas react to produce a visible image. These thermal recording materials are widely used in cash register receipts, bar-coded labels, tickets, and so forth.

The thermal recording sensitivity of thermosensitive recording layers on the paper can be enhanced by placing a layer containing filler between the thermosensitive recording layer and the substrate. These intermediate layers can improve image contrast, surface smoothness, and reduce heat transfer between the thermosensitive recording layer and the substrate. With the use of such intermediate layers, the thermal printing head can be maintained in close proximity to the thermosensitive recording layer during the printing operation while permitting a large part of the thermal energy from the thermal printing head to be concentrated in the thermosensitive recording layer.

Decreasing the amount of thermal energy required to form an image can increase the recording speed. However, decreasing the applied thermal energy also can reduce image quality when conventional thermosensitive recording media are used. Accordingly, there is a desire for thermal recording materials that can be imprinted using low thermal energy while retaining image sharpness.

SUMMARY

According to the present teachings, a thermosensitive recording medium can be made from a thermosensitive recording composition and a substrate. The thermosensitive recording composition can comprise a leuco dye, a color developer, a binder, and hollow polymeric particles, wherein the hollow polymeric particles comprise an internal void volume comprising a fluid. In some embodiments, the thermosensitive recording composition also comprises a sensitizer.

Exemplary hollow polymeric particles can comprise an internal void volume of greater than 20% or greater than 50%. In certain embodiments, the fluid in the internal void volume is a liquid. In other embodiments, the fluid is a gas, for example, air. In various embodiments, both a liquid and a gas are present. In some embodiments, the hollow polymeric particles are substantially spherical and/or substantially opaque. In some embodiments, the hollow polymeric particles comprise a thermoplastic polymer, for example, a styrene acrylic co-polymer. In certain embodiments, the hollow polymeric particles have a mean diameter of less than about 2 μm or less than about 1 μm. In particular embodiments, the hollow polymeric particles have a melting point or a softening point at a temperature less than about 120° C. or less than about 100° C.

A thermosensitive recording medium of the present teachings comprises a substrate and a thermosensitive recording composition disposed on and/or over at least a portion of a surface of the substrate. In some embodiments, the thermosensitive recording medium comprises a topcoat that is disposed on and/or over at least a portion of the thermosensitive recording composition. In certain embodiments, the topcoat comprises a topcoat binder and a pigment. In particular embodiments, the topcoat is cured with a crosslinker. In some embodiments, the substrate comprises paper, a polymer, a metal, or combinations thereof. A substrate can also include other layers, materials, or compositions for particular applications. Such additional structure and compositions can define the substrate.

Another aspect of the present teachings is a method of making a thermosensitive recording medium. The method generally comprises preparing a thermosensitive recording composition and disposing the thermosensitive recording composition on and/or over a least a portion of a surface of the substrate. In some embodiments, the method comprises curing or drying the thermosensitive recording composition. In various embodiments, the method comprises disposing a topcoat on and/or over at least a portion of the thermosensitive recording composition. In some embodiments, the topcoat is cured.

Yet another aspect of the present teachings is a method of using a thermosensitive recording medium. The method comprises exposing a thermosensitive recording medium to thermal energy to induce a visible color change. In various embodiments, the thermal energy transforms the hollow polymeric particles from opaque to translucent or transparent.

The foregoing, and other features and advantages of the present teachings will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWING

It should be understood that the drawing is not necessarily to scale, with emphasis generally being placed upon illustrating the principles of the present teachings. The drawing is not intended to limit the scope of the present teachings in any way.

DETAILED DESCRIPTION

Figure 1:
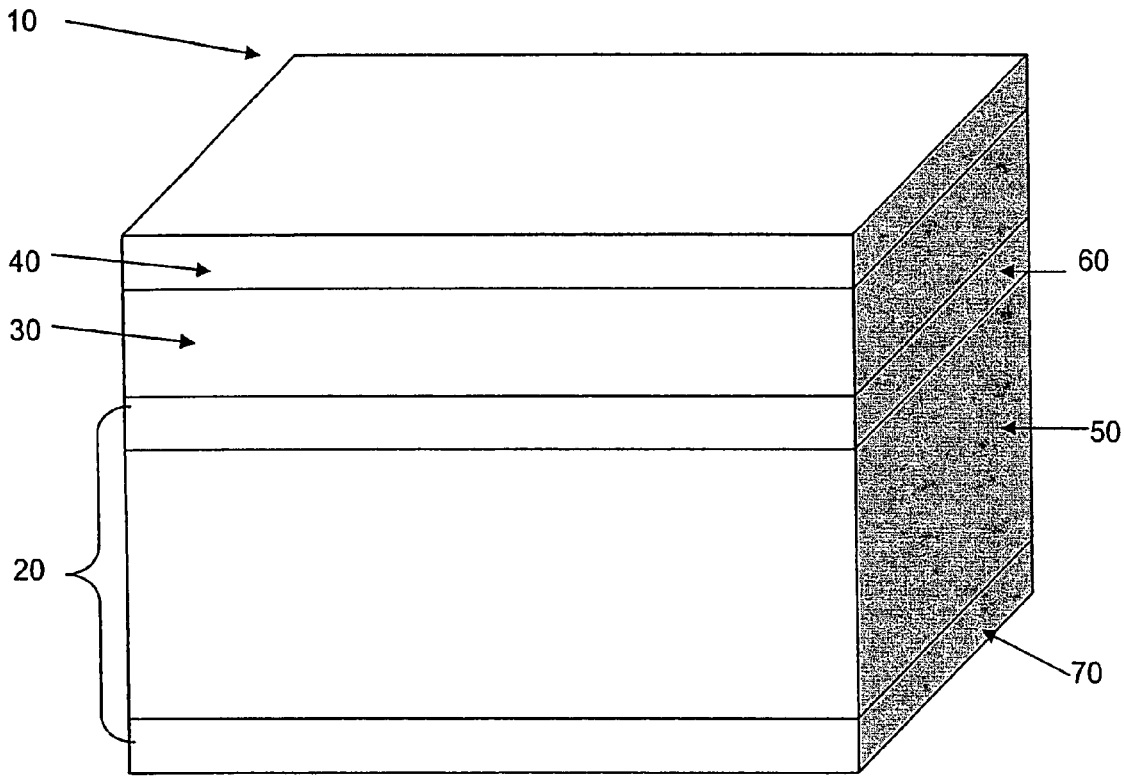
FIG. 1 is a schematic perspective view of an embodiment of a thermosensitive recording medium according to the present teachings.

The present teachings provide, in part, thermosensitive recording compositions, which are useful for preparing thermosensitive recording media. The thermosensitive recording media can be suitable for conventional use as recording materials including tickets, for example, airline, railroad, concert and lottery tickets, and for labels, including supermarket and medical labels. Further, the thermosensitive recording compositions and the thermosensitive recording media can be used with a variety of printers and processors including, but not limited to, offset and flexo printing.

Throughout the description, where compositions are described as having, including, or comprising specific components, or where processes are described as having, including, or comprising specific process steps, it is contemplated that compositions of the present teachings also consist essentially of, or consist of, the recited components, and that the processes of the present teachings also consist essentially of, or consist of, the recited processing steps. It should be understood that the order of steps or order for performing certain actions is immaterial so long as the method remains operable. Moreover, two or more steps or actions can be conducted simultaneously.

In the application, where an element or component is said to be included in and/or selected from a list of recited elements or components, it should be understood that the element or component can be any one of the recited elements or components and can be selected from a group consisting of two or more of the recited elements or components.

The use of the singular herein includes the plural (and vice versa) unless specifically stated otherwise. In addition, where the use of the term "about" is before a quantitative value, the present teachings also include the specific quantitative value itself, unless specifically stated otherwise.

It is to be understood that any percentages provided herein are percentages based on the total dry weight of the coating, unless otherwise indicated or commercially provided.

According to the present teachings, a thermal recording material, for example, a thermosensitive recording medium, that can be used in low energy thermal printing operations can include a substrate, a thermosensitive recording composition, and a topcoat. The substrate can be paper, a polymer, a metal or combinations thereof. A substrate can comprise multiple layers, for example, a paper having one or more coatings or layers on one or more of its surfaces. A thermosensitive recording composition can be deposited on or over the substrate. That is, the thermosensitive recording composition can be directly deposited on the surface of a substrate or can be indirectly deposited on a substrate with intervening materials or layers therebetween. Additionally, a topcoat can be deposited on or over the thermosensitive recording composition. Visible images can be recorded with the thermosensitive recording media through the use of a thermal energy source, for example, a thermal print head.

FIG. 1 is a schematic perspective view of an embodiment of a thermosensitive recording medium according to the present teachings. The exemplary thermosensitive recording medium 10 comprises a substrate 20, a thermosensitive recording composition 30 and a topcoat 40. In this embodiment, the substrate 20 comprises paper 50, a precoat 60, and a backcoat 70. Such a substrate is useful in the present teachings.

The substrate can comprise paper, a polymer, a metal, or any combinations thereof. The substrate serves as the base to which the thermosensitive recording composition is applied. A paper substrate or support upon which the thermosensitive recording composition is applied can be of any commercially available type suitable for thermal printing operations. Such a paper is typically characterized by high quality, uniformity in thickness, and of a basis weight preferably in the range of about 20 lbs. to 200 lbs per 3000 $ft^2$, 30 lbs. to 150 lbs. per 3000 $ft^2$, or 40 lbs. to 100 lbs. per 3000 $ft^2$. However, papers of other weights can be used depending on the end use demands. The paper can be formed from a web of one or more types of cellulosic papermaking fibers. The paper also can be calendered, if amenable, to improve surface smoothness.

In the embodiment shown in FIG. 1, the substrate also comprises a precoat on the paper that can improve the holdout of the paper, i.e., it can prevent the thermal sensitive recording composition from soaking into the paper. The precoat also can add heat sink properties. Precoats are known in the art and usually comprise calcined clay, starch, and the like, including combinations thereof.

Again referring to FIG. 1, the substrate can comprise a backcoat, which can be present to control paper curl and to improve the printability of the media on a press, e.g., most tickets contain printing on their back side. Backcoats are known in the art and usually comprise calcined clay, starch, a styrene butadiene emulsion, and the like, including combinations thereof.

In some embodiments, the thermosensitive recording composition can comprise a dispersion comprising a leuco dye, a color developer, a binder, and hollow polymeric particles. In various embodiments, the thermosensitive recording composition can also comprise a sensitizer. The particular composition of the thermosensitive recording compositions should be apparent to those skilled in the art. That is, the percentage of the components in the thermosensitive recording compositions typically are similar to those known in the art, with the exception being the addition of hollow polymeric particles. The weight percentage of the hollow polymeric particles in the thermosensitive recording composition can range from about 10% to about 80%, from about 20% to about 50%, and from about 25% to about 40%.

Leuco dyes can be used as a coloring agent in the thermosensitive recording compositions. Exemplary classes of leuco dyes include, but are not limited to, triphenyl methane-type leuco dyes, fluoran-type leuco dyes, phenothiazine-type leuco dyes, auramine-type leuco dyes, spiropyran-type leuco dyes, indolinophthalide-type leuco dyes, and the like, including combinations thereof.

Leuco dyes include, but are not limited to, 3,3-bis(p-dimethylaminophenyl)phthalide, 3,3-bis(p-dimethylaminophenyl)-6-dimethylaminophthalide (i.e., Crystal Violet Lactone), 3,3-bis(p-dimethylaminophenyl)-6-diethylaminophthalide, 3,3-bis(p-diethylaminophenyl)-6-chlorophthalide, 3,3-bis(p-dibutylaminophenyl)phthalide, 3-N-methyl-N-isobutyl-6-methyl-7-anilinofluoran, 3-N-ethyl-N-isoamyl-6-methyl-7-anilinofluoran, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-[N-(3'-trifluoromethylphenyl)amino]-6-diethylamino-fluoran, 2-[3,6-bis(diethylamino)-9-(o-chloroanilino)xanthyl]-benzoic acid lactam, 3-diethylamino-6-methyl-7-(m-trichloromethylanilino)-fluoran, 3-diethylamino-7-(o-chloroanilino)fluoran, 3-di-n-butylamino-7-(o-chloroanilino)fluoran, 3-N-methyl-N-n-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)-fluoran, benzoyl leuco methylene blue, 6'-chloro-8'-methoxybenzoindolino-spiropyran, 6'-bromo-3'-methoxybenzoindolino-spiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'- methylphenyl)phthalide, 3-(2'-methoxy-4'-dimethylaminophenyl)-3-(2'-hydroxy-4'-chloro-5'-methylphenyl)phthalide, 3-morphorino-7-(N-propyl-trifluoromethylanilino)-fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyl-toluidino)-7-(p-n-butylanilino)fluoran, 3-(N-methyl-N-isopropylamino)-6-methyl-7-anilinofluoran, 3-dibutylamino-6-methyl-7-anilinofluoran, 3,6-bis(dimethylamino) fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzofluoran, 3-N-methyl-N-isobutyl-6-methyl-7-anilinofluoran, and the like. Leuco dyes can be employed alone or in combination.

According to the present teachings of the invention, a color developer can react with the above-mentioned leuco dyes to induce color formation. Suitable classes of color developers useful in embodiments of the present teachings can comprise known electron acceptors or oxidizing agents, such as phenolic compounds, thiophenolic compounds, thiourea derivatives, organic acids and their metal salts, and the like, including combinations thereof.

Exemplary color developers include, but are not limited to, 4,4'-isopropylidenediphenol, 4,4'-isopropylidenebis(o-methylphenol), 4,4'-sec-butylidenebisphenol, 4,4'-isopropylidenebis(2-tert-butylphenol), 4,4'-cyclohexylidenebisdiphenol, 4,4'-isopropylidenebis(2-chlorophenol), 2,2'-methylenebis(4-methyl-6-tert-butylphenol), 2,2'-methylenebis(4-ethyl-6-tert-butylphenol), 4,4'-butylidenebis (6-tert-butyl-2-methyl)phenol, 1,1,3-tris(2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methyl)phenol, 4,4'-diphenolsulfone, 4-isoproxy-4'-hydroxydiphenylsulfone, 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,7-bis(4-hydroxyphenylthio)-3,5-dioxaheptane, 1,5-bis(4-hydroxyphenylthio)-3-oxapentane, 1,3-bis(4-ydroxyphenylthio)propane, 1,3-bis(4-hydroxyphenylthio)-2-hydroxypropane, N,N'-diphenylthiourea, N,N'-di(m-chlorophenyl)thiourea, salicylanilide, 5-chloro-salicylanilide, 2-hydroxy-3-naphthoic acid, 1-hydroxy-2-naphthoic acid, hydroxy naphthoic acid metal salts such as zinc, aluminum or calcium, bis(4-hydroxyphenyl)acetic acid methyl ester, bis(4-hydroxyphenyl)acetic acid benzyl ester, 1,3-bis(4-hydroxycumyl)benzene, 1,4-bis(4-hydroxycumyl) benzene, 2,4'-diphenolsulfone, 3,3'-diallyl-4,4'-diphenolsulfone, α,α-bis(4-hydroxyphenyl)-α-methyltoluene, antipyrine complex of zinc thiocyanate, tetrabromobisphenol A, tetrabromobisphenol S, and the like. Color developers can be used alone or in combination.

The thermosensitive recording composition also can include a binder (or a binder resin) which can assist in fixing the leuco dye and the color developer on a substrate. In some embodiments, the binder can include, but is not limited to, water-soluble resins such as polyvinyl alcohol, carboxyl modified polyvinyl alcohol, starch and its derivatives, cellulose derivatives (e.g., hydroxymethyl cellulose, hydroxyethyl cellulose, carboxymethyl cellulose, methyl cellulose, ethyl cellulose, and the like), polyacrylic acid sodium salt, polyvinylpyrrolidone, acrylamide-acrylate copolymers, acrylamide-acrylate-methacrylic acid copolymers, alkali metal salts of styrene-maleic anhydride copolymers, alkali metal salts of ethylene-maleic anhydride copolymers, alkali metal salts of isobutylene-maleic anhydride copolymers, polyacrylamide, sodium alginate, casein, gelatin and the like, emulsions of resins such as polyvinyl acetate, polyurethane, polyacrylic acid, polyacrylate, vinyl chloride-vinyl acetate copolymers, polybutyl methacrylate, ethylene-vinyl acetate copolymers, styrene-butadiene copolymers, styrene-butadiene-acryl copolymers, and the like. Binders can be used alone or in combination.

The thermosensitive recording composition also can comprise one or more hollow polymeric particles. The hollow polymeric particles typically are dispersed throughout the thermosensitive recording composition and in certain embodiments, are uniformly dispersed throughout the thermosensitive recording composition. Without wishing to be bound to any particular theory, it is believed that when thermal energy from a thermal print head is applied to a dried thermosensitive recording composition, for example, as part of a thermosensitive recording medium, the hollow polymeric particles melt or soften instead of acting as insulators. The melted hollow polymeric particles typically collapse and reduce in volume upon melting or softening. The reduction in volume of the hollow polymeric particles can increase the volume ratio or concentration of the coloring agents (e.g., the leuco dye) in the thermosensitive recording composition. The increase in the coloring agents can, in turn, increase the optical density of the resultant thermally generated image. The increased optical density, particularly at lower thermal energies, can permit an increase in the recording speed and/or characteristics of the image.

The hollow polymeric particles generally comprise an internal void volume. The internal void volume of the hollow polymeric particles can be greater than about 10%, greater than about 20%, greater than about 30%, greater than about 40%, or greater than about 50% of the total volume of the hollow polymeric particles. In certain embodiments, the internal void volume is greater than 55%. In defining the internal void volume of the hollow polymeric particles, it should be understood that each particle within a sample of hollow polymeric particles need not be measured for its specific internal void volume. Rather, as is known in the art, a sample containing many particles usually is subjected to testing to determine the internal void volume for a particular sample or batch of particles.

The internal void volume of the hollow polymeric particles typically comprises a fluid. The fluid can be a liquid, a gas, or a combination thereof. In some embodiments, the liquid can be water. In certain embodiments, upon the application of heat to the hollow polymeric particles, the internal void volume changes from a liquid to a gas. For example, when initially in a thermosensitive recording composition, the hollow polymeric particles usually are filled with water. However, after drying the thermosensitive recording composition, the water can be driven out of the hollow polymeric particles such that a gas (e.g. air) remains in the internal void volume. Prior to the complete removal of the water, both a liquid and gas occupy the internal void volume, which also can occur in a final product prior to use.

Exemplary hollow polymeric particles in the thermosensitive recording composition are substantially spherical in shape. In some embodiments, the hollow polymeric particles have a mean diameter of about 2.0 μm, or less, or about 1.0 μm or less. In certain embodiments, the hollow polymeric particles have diameters in the range of about 0.4 μm to about 2.0 μm, or a diameter in the range of about 0.4 μm to about 2.0 μm. It should be understood that for non-spherical particles, the mean diameter takes into account the cross-sectional dimension of the particles, with the value of the mean diameter typically being within a distribution of diameters at a confidence level of about 95%.

The hollow polymeric particles can comprise a thermoplastic polymer. A thermoplastic polymer typically retains its chemical composition upon heating and cooling, possibly in many such cycles. That is, a thermoplastic polymer can melt or soften upon the application of sufficient heat, i.e., thermal energy, to form a liquid or viscous composition. The softening point of a hollow polymeric particle can be considered the temperature at which the particle begins to melt, begins to lose its crystalline structure, and/or becomes at least slightly viscous and/or able to be shaped. When cooled, the melted or softened thermoplastic polymer can return to its original solid or crystalline form, although not necessarily in its original shape. Various thermoplastic polymers or polystyrenes can melt or soften at temperatures of less than about 120° C., or less than about 100° C. These temperatures typically correspond to the melting points of one or more of the sensitizers that can be employed in a thermosensitive recording composition. Accordingly, various embodiments include hollow polymeric particles having a melting or softening point less than about 120° C., or less than about 100° C. In particular embodiments, the thermoplastic polymer particles are opaque in their original unheated state and upon the application of sufficient heat can become transparent or translucent.

In some embodiments, the hollow polymeric particles can be formed from a styrene acrylic co-polymer, an example of a thermoplastic polymer. Hollow styrene acrylic co-polymer particles can provide acceptable pigmenting properties and thermoplastic properties. In various embodiments, the hollow styrene co-polymer particles transform during the thermal printing process from an opaque pigment to a transparent film, thereby enhancing the optical density of the printed image.

Suitable hollow polymeric particles are commercially available from Rohm and Haas Company as Ropaque HP-1055 (1.0 μm diameter sphere with a void volume of about 55% and a solids content of about 26.5%), Ropaque HP-543P (0.5 μm diameter sphere with a void volume of about 45% and a solids content of about 30.5%), and Ropaque OP-96 (0.5 μm sphere with a void volume of about 42% and a solids content of about 30.5%). It should be understood that two or more different types of hollow polymeric particles can be used in a particular thermosensitive recording composition.

According to the present teachings, a thermosensitive recording composition can also comprise a sensitizer. A sensitizer is commonly used in association with thermal coatings to lower their melting point, thus reducing the energy input required for image formation. In addition, a sensitizer, when melted, can be a good solvent for hollow polymeric particles and therefore can improve the thermal response of a thermosensitive recording composition or medium at lower thermal energy. Sensitizers that are useful in the present teachings are well known in the art.

Conventional sensitizers include, but are not limited to, stearic acid amide, palmitic acid amide, methoxycarbonyl-N-stearic acid benzamide N-benzoyl stearic acid amide, N-eicosanic acid amide, ethylene bis stearamide, ethylene bis stearic acid amide, behenic acid amide, methylene bis stearic acid amide, methylolamide, N-methylol stearic acid amide, terephthalic acid dibenzyl, terephthalic acid dimethyl, terephthalic acid dioctyl, p-benzyloxy benzoic acid benzyl, 1-hydroxy-2-naphthoic acid phenyl, oxalic acid dibenzyl, oxalic acid-di-methylbenzyl, oxalic acid-di-p-chlorobenzyl, 2-naphthylbenzylether, m-terphenyl, p-benzylbiphenyl, tolylbiphenylether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(2-methylphenoxy)ethane, p-methylthiophenylbenzylether, 1,4-di(phenylthio)butane, p-acetotoluidide, p-acetophenetidide, N-acetoacethyl-p-toluidine, di(biphenylethoxy)benzene, p-di(vinyloxyethoxy)benzene, and 1-isopropylphenyl-2-phenylethane, and the like. Sensitizers can be used alone or in combination.

In some embodiments, a topcoat is disposed on or over all or at least a portion of the thermosensitive recording composition. The topcoat can act as a barrier layer to prevent the hollow polymeric particles of the thermosensitive recording composition from adhering to the print head during the thermal printing process. The topcoat can contain a pigment, a topcoat binder, and optionally a crosslinker. The topcoat can be a varnish. Suitable varnishes include water-based varnishes and UV-curing varnishes. A varnish can be transparent, translucent, or opaque, depending on the amount of pigment, if any, that is present in the varnish. A water-based type of varnish is usually an acrylic emulsion polymer containing waxes, which can include a crosslinker. Suitable water-based varnishes for the present teachings are well known in the art and are commercially available. A UV-curing varnish can be used, however, as certain UV-curable monomers in the varnish can cause discoloration of the thermosensitive recording composition. A varnish layer can be clear (transparent) and glossy. If this feature is desired in an application, a varnish layer can be coated over a pigmented topcoat.

According to some embodiments of the present teachings, the topcoat of the thermosensitive recording medium can comprise one or more known resins. Examples of such resins include, but are not limited to, natural resins such as sodium alginate, starch, casein, cellulose derivatives and the like; and synthetic resins. In certain embodiments, the topcoat comprises polyvinyl alcohol ("PVA"), polymers having a plurality of carboxylic groups, polyacrylamide and/or modified resins. The topcoat can comprise derivatives of these resins which can provide good film forming capability and/or the ability to react with an alkyleneimino group included in a compound having a plurality of cross linking alkyleneimino groups. Suitable modified resins and derivatives of these resins include, among others, copolymers obtained by copolymerizing or graft-copolymerizing one or more other components with PVA, a polymer having a plurality of carboxyl groups, or polyacrylamide, or by combining one or more other components with the functional groups of PVA, a polymer having a plurality of carboxyl groups, or polyacrylamide. Examples of modified PVAs include, but are not limited to, epoxy group-modified PVA, silanol group-modified PVA, acrylamide-modified PVA, butyral-modified PVA-maleic acid copolymers, N-methylolurethane-modified PVA, amino group-modified PVA, and substantially perfectly-saponified PVA. The substantially perfectly-saponified PVA usually has a saponification degree not less than about 98%.

The pigment of the topcoat can comprise, for example, kaolin, aluminum trihydrate, calcium carbonate, calcined clay, and combinations thereof. Exemplary topcoat binders include, but are not limited to, polyvinyl ester resins, partially hydrolyzed polyvinyl ester resins, fully hydrolyzed polyvinyl ester resins, polyvinyl resins, polystyrene resins, polyacrylic resins, polyester resins, cellulosic resins, starch, or combinations thereof. In some embodiments, the partially hydrolyzed polyvinyl esters and fully hydrolyzed polyvinyl esters comprise polyvinyl alcohol. The cellulosic resin can be carboxymethylcellulose, hydroxyethyl cellulose, nitrocellulose, hydroxypropyl cellulose, methyl cellulose, and combinations thereof. Topcoat binders can be used alone or in combination.

The topcoat can be cured with a crosslinker. The addition of a crosslinker can improve the water, plasticizer, and/or oil resistance of the thermosensitive recording medium. Examples of crosslinkers include, but are not limited to, melamine-formaldehyde resin, hexamethoxymethylmelamine, ammonium zirconium carbonate, zinc ammonium carbonate, glyoxal, adipoyl dihydrazide, or polyamide-epichlorohydrin, and combinations thereof. Crosslinkers can be used alone or in combination.

The topcoat of the thermosensitive recording medium can include auxiliary agents such as a filler, a surfactant, an ultraviolet light absorbing agent, a thermofusible material (or a lubricant), and/or an agent preventing the thermosensitive recording composition from coloring upon application of pressure.

Suitable fillers for use in the topcoat can comprise, for example, inorganic fillers and/or organic fillers. Exemplary inorganic fillers include calcium carbonate, silica, zinc oxide, titanium oxide, aluminum oxide, zinc hydroxide, barium sulfate, clay, talc, calcium carbonate and silica which are subjected to surface treatment, and the like. Exemplary organic fillers include particulate urea-formaldehyde resins, particulate styrene-methacrylic acid copolymers, particulate polystyrene resins, and the like. Fillers can be used alone or in combination.

To increase the longevity of a thermal print head and/or to reduce sticking, a heat fusing material can be included in the topcoat. In some embodiments, the heat fusing material includes animal waxes such as bees wax or shellac wax; vegetable waxes such as carnauba wax; mineral waxes such as montan wax; petroleum waxes such as microcrystalline wax; higher fatty acid amide such as higher fatty acid polyhydric alcohol ester or stearic acid amide; higher fatty acid metal salt such as zinc stearate or calcium stearate; synthetic wax such as higher amine; condensation product of fatty acid and amine; condensation product of aromatic and amine; synthetic paraffin; chlorinated paraffin; oxidized paraffin; higher straight chain glycol; 3,4-epoxyhexahydro phthalic acid dialkyl; polyethylene and polyethylene oxide, and the like. Heat fusing materials can have a melting point of from about 50° C. to about 200° C. Heat fusing materials can be used alone or in combination.

The present teachings also include a method of making a thermosensitive recording medium. The thermosensitive recording composition as discussed above, for example, containing a leuco dye, a color developer, a binder, hollow polymeric particles and optionally a sensitizer, typically is prepared by mixing and milling the components together by their appropriate ratios. Subsequently, the thermosensitive recording composition can be disposed on or over all or at least a portion of a surface of a substrate. If desired, the thermosensitive recording composition can be spotted or disposed in select areas of the substrate. In various embodiments, the thermosensitive recording composition is dried after being disposed on or over a substrate. Drying the thermosensitive recording composition can be achieved as is well known in the art, for example, under ambient conditions for a sufficient time. The drying process can fix the thermosensitive recording composition to the substrate to create a thermosensitive recording media. In some embodiments, the thermosensitive recording composition can be cured.

A topcoat, as described above, can be disposed on or over all or at least a portion of the thermosensitive recording composition. In some embodiments, the method comprises drying and/or curing the topcoat. The process for curing the topcoat can be similar to the process for curing known thermosensitive recording compositions which do not comprise hollow polymeric particles. For example, curing can be done under ambient conditions for a sufficient time. Curing tends to be time dependent, with a week not being unusually long to cure a topcoat.

In use, a thermal recording medium can be exposed to thermal energy to induce a visible color change. For example, the thermal energy can be supplied by a thermal print head. The application of thermal energy can melt or soften the hollow polymeric particles. When the hollow polymeric particles are softened or melted, they can also shrink in size. For example, the melted hollow polymeric particles can reduce in volume by about 20-85% or about 40-75%, or by more than about 35% or more than about 45%, upon the application of thermal energy. The thermal energy can also transform the hollow polymeric particles from opaque to transparent or translucent. For example, in some embodiments, the hollow polymeric particles melt and collapse to form an amorphous and transparent or translucent film.

EXAMPLES

Practice of the present teachings will be more fully understood from the following examples. The following examples illustrate various formulations which can be used to prepare thermosensitive recording media of the present teachings. The purpose of the examples is illustration only and they are not intended to be limiting. In the descriptions in the following examples, the numbers represent weight ratios in parts, unless otherwise specified.

The following are examples of aqueous dispersions made prior to forming thermal recording compositions, including thermosensitive recording compositions of the present teachings.

| Ingredient | Weight % |
|---|---|
| Dispersion A | |
| Color Former: 6'-(dipentylamino)-3'-methyl-2'(phenylamino)-spiro[isobenzofuran-1(3H), 9'-[9H]xanthen]-3-one, available from Sofix Corporation, sold under trade name BK-305. | 34.7 |
| Dispersant: Polyvinyl alcohol, available from Nippon Synthetic Chemical Industry Co, Ltd., sold under trade name Gohsenal L-3266. | 1.3 |
| Binder: Polyvinyl alcohol, available from Celanese Ltd., sold under trade name Celvol 203. | 4.2 |

-continued

| Ingredient | Weight % |
|---|---|
| Surfactant: Tetramethyl-5-decyne-4,7-diol,2,4,7,9-, available from Air Products and Chemicals, Inc., sold under trade name Surfynol 104PA. | 0.1 |
| Water | 59.7 |
| Dispersion B | |
| Color Developer: 2-4'-Dihydroxydiphenylsulfone, available from Nicca USA, Inc., sold under trade name BPS-24. | 25.7 |
| Sensitizer: Di-(p-chlorobenzyl)-oxalate, available from Dainippon Ink & Chemicals, Inc., sold under trade name HS-3519. | 16.2 |
| Image Stabilizer: 1,1,3-Tris(2-methyl-4-hydroxy-5-cyclohexylphenyl)butane, available from Asahi Denka Kogyo K.K., sold under trade name ADK ARKLS DH-43. | 2.9 |
| Dispersant: Polyvinyl alcohol, available from Nippon Synthetic Chemical Industry Co, Ltd., sold under trade name Gohsenal L-3266 | 5.3 |
| Surfactant: Tetramethyl-5-decyne-4,7-diol,2,4,7,9-, available from Air Products and Chemicals, Inc., sold under trade name Surfynol 104E. | 0.1 |
| Water | 49.8 |
| Dispersion C | |
| Aluminum trihydrate | 59.0 |
| Surfactant: Sodium polymethacrylate, available from R.T. Vanderbilt Co., Inc., sold under trade name Darvan 7. | 0.1 |
| Water | 40.9 |

After the dispersions were made by combining the ingredients in the listed proportions, they were milled and mixed. Dispersion A was placed in a horizontal grinding mill and milled to a particle size ranging from 0.5 μm to 4.5 μm. Dispersion B was placed in a horizontal grinding mill and milled to a particle size of about 4.5 μm to 10 μm. Dispersion C was mixed on a high-speed mixer until uniformly dispersed.

The following are examples to illustrate exemplary compositions of embodiments of thermosensitive recording materials, including thermosensitive recording media of the present teachings. The dispersions used in the examples were prepared as described above.

Example 1

| Ingredient | Weight % |
|---|---|
| Dispersion A | 11.6 |
| Dispersion B | 37.8 |
| Dispersion C | 16.5 |
| Binder as 11.5% solution: Polyvinyl alcohol, available from DuPont Packaging & Industrial Polymers, sold under trade name Elvanol 75-15. | 9.5 |
| Binder as 18.6% solution: Polyvinyl alcohol, available from Celanese Ltd., sold under trade name Celvol 502. | 8.5 |
| Surfactant: Tetramethyl-5-decyne-4,7-diol,2,4,7,9-, available from Air Products and Chemicals, Inc., sold under trade name Surfynol 104PA. | 0.1 |
| Water | 16.0 |

Example 2

| Ingredient | Weight % |
|---|---|
| Dispersion A | 11.6 |
| Dispersion B | 37.8 |
| Hollow polymeric particles (0.5 μm): Styrene acrylic copolymer, available from Rohm & Haas Company, sold under trade name Ropaque OP-96. | 16.5 |
| Binder as 11.5% solution: Sodium polymethacrylate, available from R.T. Vanderbilt Co., Inc., sold under trade name Darvan 7. | 9.5 |
| Binder as 18.6% solution: Polyvinyl alcohol, available from DuPont Packaging & Industrial Polymers, sold under trade name Elvanol 75-15. | 8.5 |

-continued

| Example 2 | |
|---|---|
| Ingredient | Weight % |
| Surfactant: Tetramethyl-5-decyne-4,7-diol,2,4,7,9-, available from Air Products and Chemicals, Inc., sold under trade name Surfynol 104PA. | 0.1 |
| Water | 16.0 |

| Example 3 | |
|---|---|
| Ingredient | Weight % |
| Dispersion A | 11.6 |
| Dispersion B | 37.8 |
| Hollow Polymeric Particle (0.6 μm): Styrene acrylic copolymer, available from Rohm & Haas Company, sold under trade name Ropaque OP-96. | 16.5 |
| Binder as 11.5% solution: Sodium polymethacrylate, available from R.T. Vanderbilt Co., Inc., sold under trade name Darvan 7. | 9.5 |
| Binder as 18.6% solution: Polyvinyl alcohol, available from DuPont Packaging & Industrial Polymers, sold under trade name Elvanol 75-15. | 8.5 |
| Surfactant: Tetramethyl-5-decyne-4,7-diol,2,4,7,9-, available from Air Products and Chemicals, Inc., sold under trade name Surfynol 104PA. | 0.1 |
| Water | 16.0 |

| Example 4 | |
|---|---|
| Ingredient | Weight % |
| Dispersion A | 11.6 |
| Dispersion B | 37.8 |
| Hollow polymeric particle (1.0 μm): Styrene acrylic copolymer, available from Rohm & Haas Company, sold under trade name Ropaque HP-1055. | 16.5 |
| Binder as 11.5% solution: Sodium polymethacrylate, available from R.T. Vanderbilt Co., Inc., sold under trade name Darvan 7. | 9.5 |
| Binder as 18.6% solution: Polyvinyl alcohol, available from DuPont Packaging & Industrial Polymers, sold under trade name Elvanol 75-15. | 8.5 |
| Surfactant: Tetramethyl-5-decyne-4,7-diol,2,4,7,9-, available from Air Products and Chemicals, Inc., sold under trade name Surfynol 104PA. | 0.1 |
| Water | 16.0 |

The ingredients in Examples 1-4 were individually mixed and applied over a high quality paper substrate to a dry coating weight of approximately 3.2 lb/3000 $ft^2$. Subsequently, a topcoat comprising the formulation shown in the table below was applied over the thermosensitive recording composition and cured for one week under ambient conditions. Subsequently, samples from each example were imaged on a thermal printer (Atlantek 400) and image density was measured using an X-Rite Model 400 Densometer at several energy levels for comparison. The results are presented in Table 1.

| Top Coat Formulation: | |
|---|---|
| Ingredient | Weight % |
| Dispersion D | 12.6 |
| Binder as 11.5% solution: Polyvinyl alcohol, available from Dupont Packaging & Industrial Polymers, sold under trade name Elvanol 75-1. | 57.0 |
| Lubricant as 50% dispersion: Zinc stearate, available from Crompton Corp., sold under trade name Liquazinc AQ-90. | 2.6 |

-continued

| Top Coat Formulation: | |
|---|---|
| Ingredient | Weight % |
| Crosslinker as 80% solution: Melamine-Formaldehyde Resin, available from Cytech Industries, Inc., sold under trade name Cymel 385. | 1.3 |
| Water | 26.5 |

As seen in Table 1, at the lower recording energy levels, the optical density (OD) of Example 1 which does not contain hollow polymeric particles is lower than the OD of the other examples that contain hollow polymeric particles. Also, the OD of Example 4 which contains hollow polymeric particles of increased diameter was higher than the other examples. Therefore, without wishing to be bound by any particular theory, it appears that the inclusion of hollow polymeric particles in a thermal recording composition can result in increased recording speed as the thermosensitive recording media of the present teachings are more sensitive to thermal energy. That is, visible images can be created at lower energies so that the media can be moved through a thermal printer at increased speed without jeopardizing image quality.

TABLE 1

| of Optical Density (OD) Vs Energy (mj/mm$^2$) | | | | |
|---|---|---|---|---|
| | OD @ 7.489 (mj/mm$^2$) | OD @ 8.876 (mj/mm$^2$) | OD @ 10.318 (mj/mm$^2$) | OD @ 11.742 (mj/mm$^2$) |
| Example 1 | 0.20 | 0.46 | 0.93 | 1.33 |
| Example 2 | 0.40 | 0.84 | 1.23 | 1.41 |
| Example 3 | 0.47 | 0.87 | 1.26 | 1.42 |
| Example 4 | 0.50 | 1.03 | 1.29 | 1.40 |

OTHER EMBODIMENTS

The present teachings can be embodied in other specific forms, not delineated in the above examples, without departing from the spirit or essential characteristics thereof. The present teachings can be embodied in other specific forms without departing from the spirit or essential characteristics thereof. The foregoing embodiments are therefore to be considered in all respects illustrative rather than limiting on the present teachings described herein. Scope of the present teachings is thus indicated by the appended claims rather than by the foregoing description, and all changes that come within the meaning and range of equivalency of the claims are intended to be embraced therein.

What is claimed is:

1. A thermosensitive recording composition comprising:
a leuco dye;
a color developer;
a binder; and
hollow polymeric particles, wherein the hollow polymeric particles comprise an internal void volume comprising a fluid, and wherein the fluid of the hollow polymeric particles comprises a gas.

2. The thermosensitive recording composition of claim 1, comprising a sensitizer.

3. The thermosensitive recording composition of claim 1, wherein the internal void volume is greater than about 20%.

4. The thermosensitive recording composition of claim 1, wherein the internal void volume is greater than about 50%.

5. The thermosensitive recording composition of claim 1, wherein the fluid comprises a liquid.

6. The thermosensitive recording composition of claim 1, wherein the hollow polymeric particles are substantially spherical.

7. The thermosensitive recording composition of claim 1, wherein the hollow polymeric particles are substantially opaque.

8. The thermosensitive recording composition of claim 1, wherein the hollow polymeric particles comprise a thermoplastic polymer.

9. The thermosensitive recording composition of claim 1, wherein the hollow polymeric particles have a mean diameter less than about 2 μm.

10. The thermosensitive recording composition of claim 1, wherein the hollow polymeric particles have a melting point or a softening point at a temperature less than about 120° C.

11. A thermosensitive recording medium comprising:
a substrate; and
a thermosensitive recording composition disposed on or over at least a portion of a surface of the substrate, wherein the thermosensitive recording composition comprises a leuco dye, a color developer, a binder and hollow polymeric particles, wherein the hollow polymeric particles comprise an internal void volume comprising a fluid, and wherein the fluid of the hollow polymeric particles comprises a gas.

12. The thermosensitive recording medium of claim 11, comprising a topcoat disposed on or over at least a portion of the thermosensitive recording composition.

13. The thermosensitive recording medium of claim 12, wherein the topcoat comprises a topcoat binder and a pigment.

14. The thermosensitive recording medium of claim 13, wherein the pigment comprises kaolin, aluminum trihydrate, calcium carbonate, calcined clay, or combinations thereof.

15. The thermosensitive recording medium of claim 13, wherein the topcoat binder comprises polyvinyl ester resins, partially hydrolyzed polyvinyl ester resins, fully hydrolyzed polyvinyl ester resins, polyvinyl resins, polystyrene resins, polyacrylic resins, polyester resins, cellulosic resins, starch, or combinations thereof.

16. The thermosensitive recording medium of claim 11, wherein the substrate comprises paper, a polymer, a metal, or combinations thereof.

17. A method of using a thermosensitive recording medium of claim 11, the method comprising:
exposing the thermosensitive recording composition to thermal energy to induce a visible color change.

18. A method of making a thermosensitive recording medium, the method comprising:
preparing a thermosensitive recording composition comprising a leuco dye, a color developer, a binder and hollow polymeric particles, wherein the hollow polymeric particles comprise an internal void volume comprising a fluid, and wherein the fluid of the hollow polymeric particles comprises a gas; and
disposing the thermosensitive recording composition on or over at least a portion of a surface of a substrate.

* * * * *